US005411589A

United States Patent [19]

Yoshida et al.

[11] Patent Number: 5,411,589

[45] Date of Patent: May 2, 1995

[54] COATING APPARATUS WITH COATING DIE

[75] Inventors: Makoto Yoshida; Kazuyuki Shimizu; Eiichi Morita; Masato Fujimori; Hiromi Tanaka, all of Hino, Japan

[73] Assignee: Konica Corporation, Japan

[21] Appl. No.: 990,731

[22] Filed: Dec. 15, 1992

[30] Foreign Application Priority Data

Dec. 17, 1991 [JP] Japan ..... 3-333437

[51] Int. Cl.[6] ..... B05C 1/08; B05C 3/18

[52] U.S. Cl. ..... 118/688; 118/200; 118/259; 118/419; 118/429; 118/679; 118/672; 118/712

[58] Field of Search ..... 118/668, 669, 672, 712, 118/708, 200, 239, 249, 250, 251, 256, 400, 407, 410, 419, 429, 679, 688, 259

[56] References Cited

U.S. PATENT DOCUMENTS

| | | | |
|---|---|---|---|
| 2,704,530 | 3/1955 | Nilson et al. | 118/708 X |
| 3,931,786 | 1/1976 | Teed | 118/672 X |
| 3,996,883 | 12/1976 | Gusarov et al. | 118/669 |
| 4,891,240 | 1/1990 | Ward et al. | 118/669 X |
| 4,930,440 | 6/1990 | Shirono | 118/663 |
| 5,052,338 | 10/1991 | Maiorca et al. | 118/668 |

FOREIGN PATENT DOCUMENTS

| | | | |
|---|---|---|---|
| 3126795 | 6/1982 | Germany | B05D 1/26 |
| 3927680 | 3/1990 | Germany | B05C 5/02 |
| 1439604 | 6/1976 | United Kingdom | G01B 13/12 |

*Primary Examiner*—Michael W. Ball
*Assistant Examiner*—Francis J. Lorin
*Attorney, Agent, or Firm*—Jordan B. Bierman; Bierman and Muserlian

[57] ABSTRACT

The present invention is to provide an apparatus for coating an advancing web on a backup roller Using a coating roller, which enables one to measure and control a coating gap between a lip surface of a coating die and the coating roller. The apparatus includes an extended portion which extends outward from each end of a slit portion of the coating die and has a reference surface parallel to the lip surface, the coating die is slidably located on a frame, a distance sensing means is fixed on each side of the coating roller, a distance is measured from the distance sensing means to the surface of the extended portion and the coating gap is controlled by sliding the coating die in a radial direction of the coating roller. Coating material is thereby controllably transferred from the coating roller to the web.

6 Claims, 3 Drawing Sheets

COATING APPARATUS WITH COATING DIE

BACKGROUND OF THE INVENTION

The present invention relates to a coating method and apparatus by which a coater gap can be set accurately, quickly and easily and further, the reproducing accuracy can be improved.

In an extrusion type or a slide hopper type coating apparatus, the setting of a coater gap between a coater edge and a web is one of the most important factors from the viewpoints of uniformity and stability of coating, and it is also important to improve quality and productivity. However, a method to directly detect the coater edge position has as yet not been proposed.

Conventionally, the coater gap Setting or adjusting operation is conducted by a skilled worker in the following manner before a coating operation is started or when the coating apparatus or coating roller is replaced: the skilled worker adjusts a gap between a coater edge and a web, or a gap between the coater edge and a coating roller using a thickness gauge; or a displacement of the web or coating roller with respect to the frame of the device is measured by a dial gauge or distance sensor mounted on the frame, and the skilled worker adjusts the gap in accordance with the detected value.

However, according to the aforementioned method, the position of the coater edge during coating, that is, the coater gap, can not be detected, and further in the case of replacement of a coating die, the adjusting operation must be carried out again. Therefore, working efficiency is lowered, and there is a possibility that the reproducibility is lowered.

When the coater gap is fluctuated or the coater gap is in an abnormal condition, the coated layer is of inferior quality, that is, streaks and stripes are caused on the coated layer, and further the layer thickness is deviated.

Japanese Patent Application Open to Public Inspection No. 40258/1990 discloses the following means in which the positional sensor is disposed in such a manner that: the angle formed by the positional sensor axis and the horizontal line is the same as that formed by the moving axis of the coating die and the horizontal line. Until now, there has not been proposed a coater edge position detecting means by which the coater edge position can be directly detected so as to stably obtain excellent coating properties.

SUMMARY OF THE INVENTION

It is a primary object of the present invention to directly measure the coater gap and to improve its reproduction accuracy.

In order to solve the aforementioned objects, the present invention is to provide a method for measuring and controlling the distance between the surface of a continuously conveyed web supported by a backup roller and that of an extended portion of a coating die, or the distance between the surface of a continuously rotated coating roller and that of said extended portion, said method characterized in that: the length of a coating die is longer than said backup roller or coating roller so that said extended portion can be formed; and the distance between the surface of the web and that of the extended portion, or the distance between the surface of the coating roller and that of the extended portion is measured by a distance measuring means provided on both sides of the roller, wherein the distance measuring means is disposed opposite to the extended portion. In this case, the surface of the extended portion to be measured is formed on the same surface as the edge surface provided on the tip of the coating die. It is preferable that the surface to be measured of the extended portion and the edge surface provided on the tip of the coating die, are ground at the same time.

Also, the present invention is to provide a coating apparatus that coats a coating solution on the surface of the continuously conveyed web supported by the backup roller or on the surface of the continuously rotated coating roller, said coating apparatus comprising: a coater frame; a coating die mounted on said frame; a positional control means that moves said coating die in the radial direction of the roller; a distance measuring means disposed on both sides of the roller being opposite to the surface of the coating die to be measured, wherein the distance measuring means measures the distance to the surface to be measured; and a calculation processing means to control said positional control means so that the distance measured by the distance measuring means can be a predetermined value, wherein the length of the coating die is longer than that of the roller surface, and the extended portion of the coating die is the surface to be measured.

DETAILED DESCRIPTION OF THE INVENTION

Figure 1:
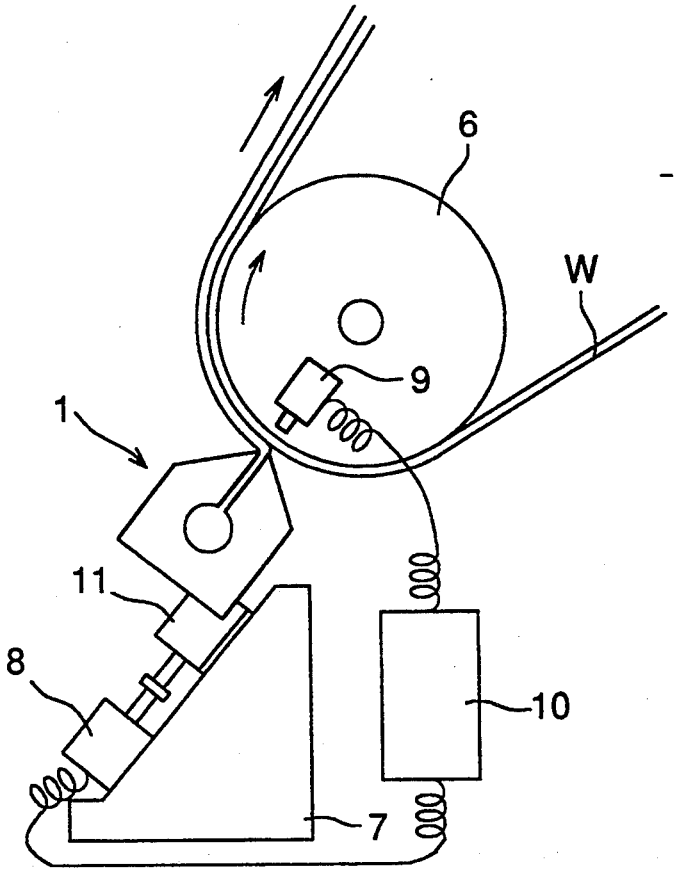
FIG. 1 is a schematic illustration showing the entire structure of the coater gap control apparatus of the present invention.
Figure 2:
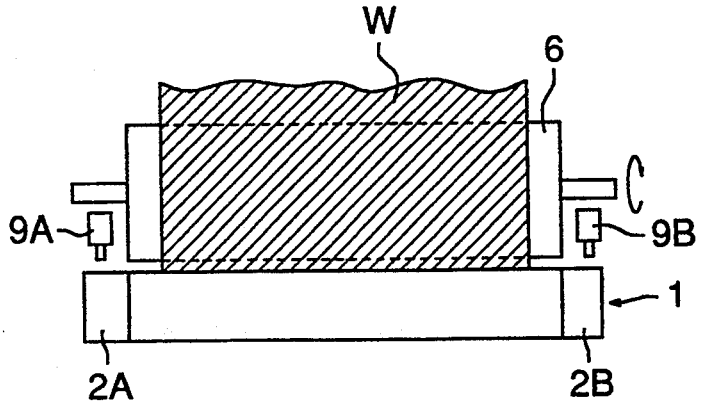
FIG. 2 is a side view showing the state of installation of the distance measuring means of the present invention.
Figure 3:
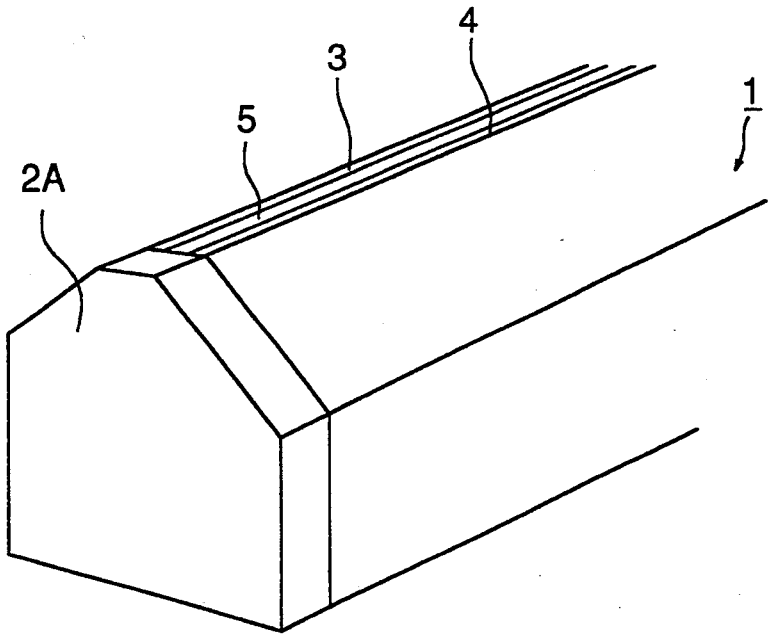
FIG. 3 is a perspective view showing the coating die of the present invention.

FIG. 1 is a schematic illustration showing the entire structure of the coater gap control device of the present invention. FIG. 2 is a side view showing the state of installation of the distance measuring means of the present invention. FIG. 3 is a perspective view showing the coating die of the present invention.

In FIGS. 1, 2, and 3, numeral 1 is an extrusion type coating die. A coating solution is extruded from a slit 5 that is formed by a front edge 3 and a back edge 4 so that the coating solution can be coated on the surface of continuously running web W supported by a backup roller 6.

In the aforementioned coating apparatus, it is important to control a gap between the surface of front edge 3 or the surface of back edge 4 and surface of web W, that is, a coating gap. Therefore, it is necessary to directly detect the position of the front edge 3 or the back edge 4.

As shown in FIGS. 2 and 3, in the present invention, when the lengths of the end plates 2A and 2B of the coating die 1 are extended, the coating die 1 is made longer than the backup roller 6. The surface to be measured of the extended portion, that is, the end plates 2A and 2B in this example, is ground together with the edge surface of the tip of the coating die 1, that is, the surface of the front edge 3 and that of the back edge 4, so that the surface to be measured can be ground to be the same surface as the front edge 3 and the back edge 4 of the coating die 1. Provided to oppose the surfaces of the end plates 2A and 2B to be measured, the distance measuring means composed of the distance sensors 9A and 9B are arranged on both sides of the backup roller 6.

More preferable is a concurrent finishing of the surfaces of the end plates and the lip portion (the front edge and the back edge) as one surface after the assembly of the main body and the end plates. Further, it is also possible to make the coating die 1 longer than the backup roller 6, and to provide sealing members to both sides of the slit in order to prevent the solution from leaking, so that the coating width can be reduced to be narrower than web W. In this case, the front edge 3 or the back edge 4 of the coating die 1 can be used for measuring.

A contact type distance sensor such as "Magnescale" made by Sony Magnescale Co. is used for the distance sensor 9. It is preferable to use a noncontact type distance sensor such as a laser type distance sensor, an ultrasonic type distance sensor or an eddy-current type distance sensor.

The coating die is mounted on the coater frame 7. The coating die can be moved in the radial direction of the backup roller 6 by a positional control means composed of a positional control motor 8 connected with the coating die 1, wherein a servo motor is used for the positional control motor 8. Numeral 10 is a calculation processing unit that is operated in the following manner: in accordance with the distances measured by the distance sensors 9A, 9B, the calculation processing unit 10 calculates a moving distance necessary for accomplishing a target coating gap; the calculation processing unit 10 outputs a positional correction signal to the positional control motor 8 so that the coater edge of the coating die 1 can be placed in a position separated from web W by a predetermined distance; and the coating die 1 is moved on the coater frame 7 through a rear holding member 11 so that the coater gap can be adjusted to be a predetermined value. In the aforementioned apparatus, the initial value of the coater gap, that is, the zero point of distance measuring can be determined in the following manner: the coating die 1 is advanced by the positional control motor 8; and when the coater edge comes into contact with the surface of web W, the initial value of distance measuring can be obtained. Instead of the servo motor 8, a hydraulic cylinder may be applied to the positional control means of the present invention in order to supply power.

In order to prevent slippage of the end plates 2A, 2B, it is preferable that a packing member is not provided between the end plate 2A and the coating die 1, or between the end plate 2B and the coating die 1. In this case, in order to prevent leakage of the coating solution from between the coating die 1 and the end plates 2A, 2B, it is preferable that the surface of the coating die 1 and that of the end plates 2A, 2B are ground to obtain a smooth surface.

Figure 4:
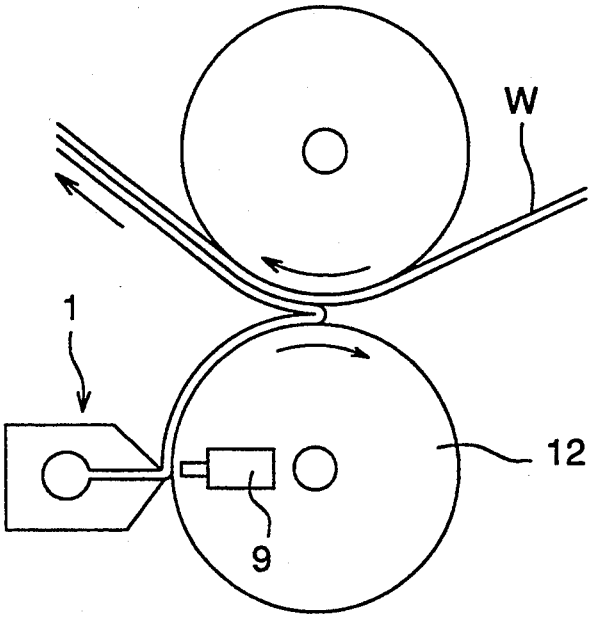
FIG. 4 is a schematic illustration showing a coating apparatus to execute the present invention.

In the above example, the present invention is applied to the apparatus of the extrusion coating method in which the coating solution is coated on the web continuously conveyed and held by the backup roller. The present invention can be also applied to the apparatus of the transfer type extrusion coating method in which a gap formed between the coating die 1 and the coating roller 12 is adjusted as shown in FIG. 4.

Figure 5:
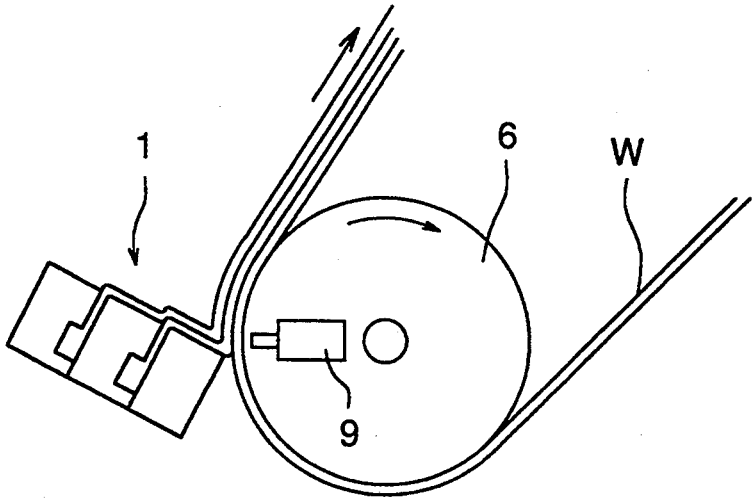
FIG. 5 is a schematic illustration showing a coating apparatus to execute the present invention.

The present invention can be applied to not only the extrusion type coating die but also the slide hopper type coating die 1 as shown in FIG. 5, and the coater edge gap detection means can be provided to the coating die 1 in the same manner as described before so as to control the gap.

As explained above, according to the present invention, the coating gap can be directly detected. Therefore, the coating gap can be accurately set at a predetermined value, and further its reproducibility can be improved. Consequently, the coating operation can be stably carried out while the accuracy of coated layer thickness is improved.

In the apparatus of the present invention, the coating die is made longer than the length of the roller surface, and the extended portion of the coating die is provided with the distance measuring means in order to measure the distance from the surface of the extended portion, and according to the result of the measurement, the distance can be controlled.

Therefore, the distance between the coater edge and the web, or the distance between the coater edge and the backup roller is directly detected, so that the gap adjusting operation can be accurately carried out. Accordingly, the occurrence of inferior coating quality such as streaks and stripes of a coated layer and defective thickness of a coated layer can be prevented.

In this case, the surface to be measured on the extended portion of the coating die is made to be the same as the edge surface of the tip of the coating die. When the surface to be measured on the extended portion and the edge surface of the tip of the coating die are ground concurrently, gap adjustment can be accurately carried out.

When the positional control means controls the moving distance of the coating die in the radial direction of the backup roller, a predetermined gap can be automatically obtained very quickly during coating while the web is running and also after the exchange of the coating die.

As explained above, according to the present invention, the coater gap can be directly detected. Therefore, the coater gap can be accurately set at a predetermined value, and further its reproducibility can be improved. Consequently, the coating operation can be stably carried out while the accuracy of coated layer thickness is improved.

What is claimed is:

1. An apparatus for coating a web comprising a backup roller supporting said web and adapted for backup rotation about a backup rotation axis, said web having a web width, and moving in an advancing direction with said backup rotation, a coating roller adapted for coating rotation about a coating rotation axis, said coating axis being substantially parallel to said backup axis and adjacent said web, whereby coating material is transferred from said coating roller to said web, said apparatus further comprising a coating die having a dispensing slit with its longitudinal dimension substantially parallel to said coating axis, perpendicular to said advancing direction, and adjacent said coating roller, said die being movable toward and away from a peripheral surface of said coating roller to form an adjustable gap therebetween, said coating die comprising a lip surface, said lip surface facing said peripheral surface of said coating roller thereby forming said adjustable gap, at least one extended portion of said die extending beyond said coating roller in said longitudinal direction, said extended portion constituting a reference surface which is fixed with respect to said lip surface, whereby location of said lip surface can be determined by location of said extended portion;

a distance locator at a fixed position on a side of said coating roller adapted to measure a distance from said fixed position to said reference surface; and a control for adjusting said gap by moving said coating die toward or away from said coating roller based on said distance from said coating die to said coating roller.

2. The apparatus of claim 1 wherein said extended portion is integral with said coating die and coplanar with said lip surface.

3. The apparatus of claim 1 wherein said lip surface is wider than said web width, thereby forming at least one said extended portion.

4. The apparatus of claim 1 wherein said coating die comprises at least one end plate, said end plate affixed to said coating die and constituting said extended portion.

5. The apparatus of claim 4 wherein said extended portion of said end plate and said lip surface are ground together so as to be coplanar.

6. The apparatus of claim 1 further comprising a sensor associated with said extended portion adapted to measure a distance between a predetermined position and said reference surface.

* * * * *